US009457820B2

(12) United States Patent
Kimura et al.

(10) Patent No.: US 9,457,820 B2
(45) Date of Patent: Oct. 4, 2016

(54) SPEED PROFILE GENERATION APPARATUS AND DRIVER ASSISTANCE SYSTEM

(71) Applicant: Mitsubishi Electric Corporation, Chiyoda-ku (JP)

(72) Inventors: Sae Kimura, Tokyo (JP); Satoru Takahashi, Tokyo (JP); Kenji Ueda, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 14/513,850

(22) Filed: Oct. 14, 2014

(65) Prior Publication Data

US 2015/0120101 A1 Apr. 30, 2015

(30) Foreign Application Priority Data

Oct. 25, 2013 (JP) ..... 2013-222036
Jun. 19, 2014 (JP) ..... 2014-125851

(51) Int. Cl.
*B61L 27/00* (2006.01)
*B61L 3/00* (2006.01)
*B61L 25/02* (2006.01)

(52) U.S. Cl.
CPC ..... *B61L 27/0027* (2013.01); *B61L 3/008* (2013.01); *B61L 25/025* (2013.01); *B61L 25/026* (2013.01)

(58) Field of Classification Search
CPC .... B61L 3/008; B61L 25/025; B61L 25/026; B61L 27/0027
USPC ..... 701/20
See application file for complete search history.

(56) References Cited

U.S. PATENT DOCUMENTS 4,566,067 A * 1/1986 Sahasrabudhe ..... B61L 3/221 701/117
5,239,472 A * 8/1993 Long ..... G07C 5/004 246/182 R
5,346,163 A * 9/1994 Momma ..... B60M 3/00 104/301
6,332,107 B1 * 12/2001 Gordon ..... B61L 3/006 246/182 A
6,873,962 B1 * 3/2005 Doner ..... B61L 27/0016 701/19
8,295,993 B2 * 10/2012 Kumar ..... B61L 3/006 701/100
8,370,006 B2 * 2/2013 Kumar ..... B61L 3/006 701/19

(Continued)

FOREIGN PATENT DOCUMENTS

JP 5-105081 4/1993
JP 7-76276 3/1995

(Continued)

*Primary Examiner* — Atul Trivedi
(74) *Attorney, Agent, or Firm* — Oblon, McClelland, Maier & Neustadt, L.L.P.

(57) ABSTRACT

A speed profile generation apparatus includes: an input unit that receives train performance, route information, information regarding a landmark, a starting position and ending position of generating a speed profile, and a starting time and target ending time of the speed profile; and a speed profile generator that generates the speed profile based on the information inputted to the input unit, the speed profile switching a traveling mode of a train by taking a position of the landmark as a reference.

9 Claims, 16 Drawing Sheets

(56) References Cited

U.S. PATENT DOCUMENTS 8,630,757 B2 * 1/2014 Daum ..... B61L 3/006 701/19
8,670,890 B2 * 3/2014 Fournier ..... G06Q 10/04 701/20
8,924,049 B2 * 12/2014 Kumar ..... B61L 27/0027 701/19
8,998,617 B2 * 4/2015 Kumar ..... B61L 3/006 434/29
2004/0010432 A1 * 1/2004 Matheson ..... B61L 27/0016 705/7.22
2007/0219681 A1 * 9/2007 Kumar ..... B61L 3/006 701/19
2008/0033605 A1 * 2/2008 Daum ..... B61L 3/006 701/19
2008/0125924 A1 * 5/2008 Daum ..... B61L 3/006 701/19
2008/0167767 A1 * 7/2008 Brooks ..... B61L 3/006 701/20
2008/0183345 A1 * 7/2008 Chandra ..... B61L 3/006 701/19
2008/0195269 A1 * 8/2008 Lacy ..... B61L 3/006 701/24
2009/0125170 A1 * 5/2009 Noffsinger ..... B60L 7/16 701/20
2009/0186325 A1 * 7/2009 Kumar ..... B61C 17/12 434/219
2009/0187291 A1 * 7/2009 Daum ..... B61L 3/006 701/2
2009/0234521 A1 * 9/2009 Kumar ..... B60L 11/1851 701/19
2009/0299555 A1 * 12/2009 Houpt ..... B61L 27/0027 701/19
2010/0023190 A1 * 1/2010 Kumar ..... B61L 3/006 701/20
2010/0262321 A1 * 10/2010 Daum ..... B61L 3/006 701/20
2010/0318247 A1 * 12/2010 Kumar ..... B61L 3/006 701/20
2012/0245770 A1 * 9/2012 Yamamoto ..... B61L 27/0027 701/20
2012/0277940 A1 * 11/2012 Kumar ..... B61L 27/0027 701/20
2014/0103166 A1 * 4/2014 Asuka ..... B61L 23/24 246/4
2014/0180510 A1 * 6/2014 Fournier ..... B61L 27/0027 701/20
2014/0222259 A1 * 8/2014 Yoshimoto ..... B61L 27/0027 701/20

FOREIGN PATENT DOCUMENTS

JP 3919553 5/2007
WO WO 2013/057969 A1 4/2013

* cited by examiner

| POSITION OF LANDMARK | TYPE OF LANDMARK |
|---|---|
| 0 | SIGNAL |
| 250 | SIGNAL |
| 350 | CONSTRUCTION |
| 500 | SIGNAL |
| 750 | SIGNAL |
| 800 | CONSTRUCTION |
| 850 | INDICATOR |

| | | |
|---|---|---|
| PLAN 1 | STARTING POSITION - ENDING POSITION | TRAVELING MODE |
| | 0 - 250 | ACCELERATION |
| | 250 - 750 | CONSTANT SPEED |
| | 750 - 1000 | DECELERATION |
| PLAN 2 | STARTING POSITION - ENDING POSITION | TRAVELING MODE |
| | 0 - 250 | ACCELERATION |
| | 250 - 500 | CONSTANT SPEED |
| | 500 - 850 | COASTING |
| | 850 - 1000 | DECELERATION |
| PLAN 3 | STARTING POSITION - ENDING POSITION | TRAVELING MODE |
| | 0 - 250 | ACCELERATION |
| | 250 - 350 | COASTING |
| | 350 - 800 | CONSTANT SPEED |
| | 800 - 1000 | DECELERATION |

FIG. 8

| POSITION OF LANDMARK | TYPE OF LANDMARK | USABLE TIME PERIOD |
|---|---|---|
| 0 | SIGNAL | 0:00 - 24:00 |
| 250 | SIGNAL | 0:00 - 24:00 |
| 350 | CONSTRUCTION | 6:00 - 22:00 |
| 500 | SIGNAL | 0:00 - 24:00 |
| 750 | SIGNAL | 0:00 - 24:00 |
| 800 | CONSTRUCTION | 6:00 - 22:00 |
| 850 | INDICATOR | 6:00 - 17:00 |

FIG. 13

| POSITION | DRIVE INSTRUCTION | SCHEDULED SWITCHING TIME (STARTING TIME IS DEFINED AS 0) |
|---|---|---|
| 0 | ACCELERATION | 0 |
| 250 | CONSTANT SPEED | 30 |
| 750 | DECELERATION | 38 |

SPEED PROFILE GENERATION APPARATUS AND DRIVER ASSISTANCE SYSTEM

BACKGROUND OF THE INVENTION

1. Field of the Invention

The present invention relates to a speed profile generation apparatus that generates a train speed profile, and a driver assistance system.

2. Description of the Background Art

In a railway system, how a train should travel between stations is planned in advance in order to achieve safe, accurate and comfortable train service. As a diagram that represents a traveling plan of the train, a speed profile (traveling curve) is used, which illustrates a relationship between a position and speed of the train and a time. A train driver carries out a drive operation so as to allow the train to travel following the speed profile. Note that the speed profile is also referred to as a run curve and a running profile.

Heretofore, based on an experience and a manual of a speed profile designer, the speed profile has been designed in order to satisfy with the constraints of an inter-station traveling time schedule, which includes a margin time, a gradient and a speed limit. However, in a case where the train cannot travel in accordance with the planned speed profile because of a reason such as timetable disruption, it is necessary for the train driver to determine an appropriate drive operation based on an experience thereof. Therefore, such problems occur that an inexperienced train driver carries out an inappropriate drive operation, and that a workload on the train driver is increased.

In order to solve the problems as described above, there is proposed a method for setting a new inter-station target traveling time schedule, which ranges from a current time to a planned arrival time to a next station, and automatically generating such a speed profile that satisfies the inter-station target traveling time schedule, thereby assisting the train driver and a conductor. In Japanese Patent Application Laid-Open No. H05-105081 (1993), information for generating the speed profile and a drive operation instruction, a passenger-oriented guide and the like is automatically generated and stored in a recording medium. At the respective positions stored in the recording medium, the drive operation instruction and a passenger-oriented guide broadcast are automatically outputted by a display and a voice.

SUMMARY OF THE INVENTION

The conventional speed profile is represented by taking a kilometer distance or a relative distance from a station as a reference. However, in actual train service, it is difficult for the train driver to perform the drive operation while grasping current accurate kilometer distance and or relative distance. Instead, the train driver usually memorizes the drive operation while taking positions of railway facilities such as signals and indicators and constructions on peripheries thereof as index marks. The railway facilities and the constructions, which serve as the index marks for the drive operation, are referred to as landmarks. In the conventional speed profile generation apparatus and the driver assistance system (traveling assistance apparatus), the speed profile is generated without considering the positions of the landmarks, and accordingly, there is a possibility that the train driver may have to perform the drive operation at a position where the train driver do not usually perform drive operation in the generated speed profile, and it is considered to become difficult for the train driver to grasp the position to perform the drive operation.

It is an object of the present invention to obtain a speed profile generation apparatus in which it is easy for the train driver to grasp the position to perform the drive operation.

A speed profile generation apparatus according to the present invention includes: an input unit; and a speed profile generator. The input unit receives train performance, route information, information regarding a landmark, a starting position and ending position of generating a speed profile, and a starting time and target ending time of the speed profile. The speed profile generator generates the speed profile, which switches a traveling mode of a train by taking a position of the landmark as a reference, based on the information inputted to the input unit.

In accordance with the present invention, in response to a predetermined target traveling time schedule, the speed profile can be generated, from which it is easy for the train driver to grasp the position to perform the drive operation while keeping the speed limit. Moreover, an instruction on the drive operation is issued to the train driver by using the speed profile as described above, and driver assistance is performed therefore, whereby it becomes easy to achieve traveling of the train, which is in accordance with the speed profile.

These and other objects, features, aspects and advantages of the present invention will become more apparent from the following detailed description of the present invention when taken in conjunction with the accompanying drawings.

BRIEF DESCRIPTION OF THE DRAWINGS

FIG. 8 is a table showing an example of information received by a landmark input unit in the second preferred embodiment of the present invention;

FIG. 13 is a table showing examples of drive operation instructions in the fourth preferred embodiment of the present invention;

DESCRIPTION OF THE PREFERRED EMBODIMENTS

First Preferred Embodiment

Figure 1:
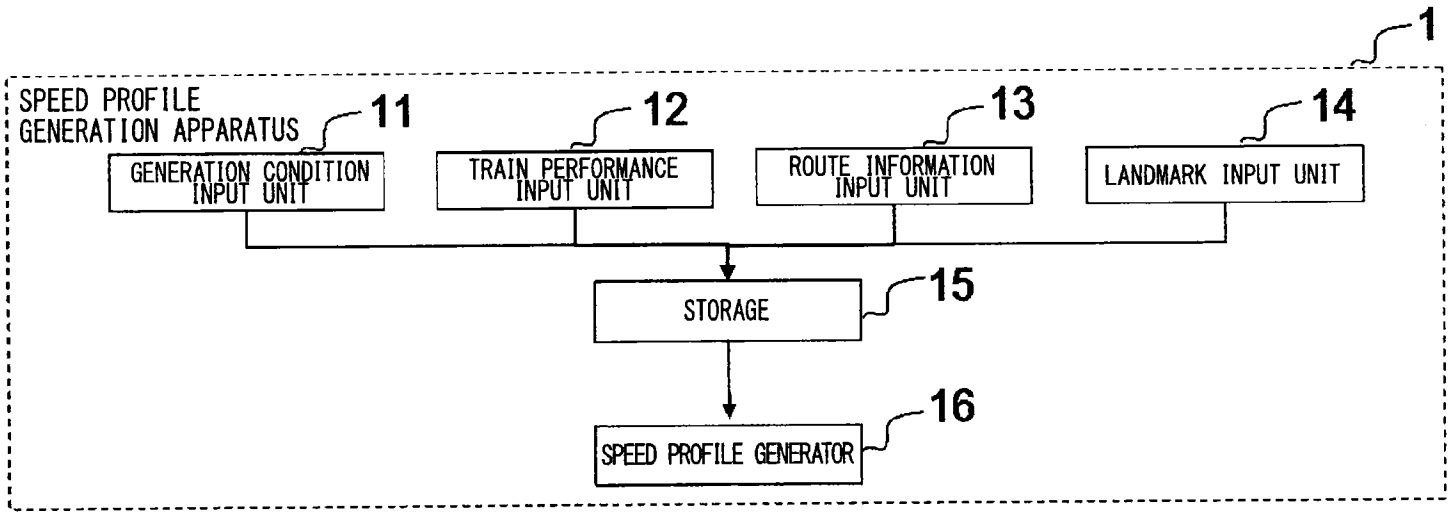
FIG. 1 is a configuration diagram of a speed profile generation apparatus in a first preferred embodiment of the present invention.

FIG. 1 is a configuration diagram showing a speed profile generation apparatus according to a first preferred embodiment of the present invention. Note that those assigned with the same reference numerals are the same ones or equivalents thereof, and this matter is common to the whole text of the specification and all of the drawings. Moreover, forms of the constituent elements, which are shown in the whole text of the specification, are merely for exemplification, and are not limited to these descriptions.

By using FIG. 1, a description is made of a configuration of a speed profile generation apparatus 1 according to the first preferred embodiment. The speed profile generation apparatus 1 is composed of a generation condition input unit 11, a train performance input unit 12, a route information input unit 13, a landmark input unit 14, a storage 15, and a speed profile generator 16.

The generation condition input unit 11 receives input of generation conditions for generating a speed profile, which includes a starting position (starting station) and an ending position (ending station), a starting speed and an ending speed, a starting time and a target ending time, and the like. The train performance input unit 12 receives input of train performance and the like, which includes a train length and a train weight, acceleration performance and deceleration performance, and traveling resistance. The route information input unit 13 receives input of information regarding a target route and the like, which includes a speed limit, a gradient, and a position and curvature radius of a curve.

Figures 2, 3:
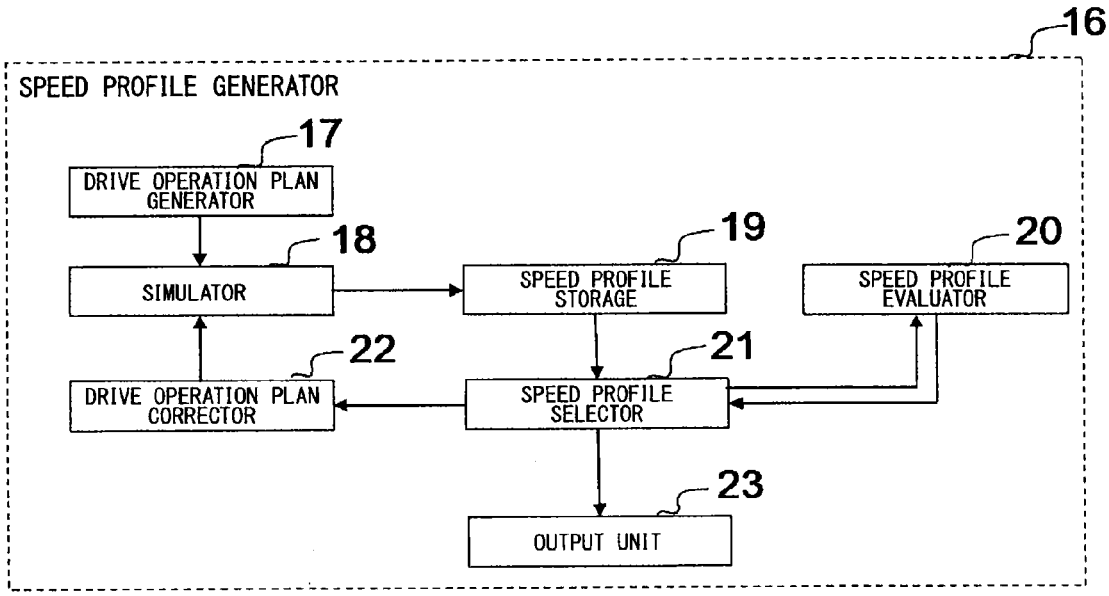
FIG. 2 is a table showing an example of information received by a landmark input unit in the first preferred embodiment of the present invention.
FIG. 3 is a configuration diagram of a speed profile generator in the first preferred embodiment of the present invention.

FIG. 2 is a table showing an example of information received by the landmark input unit 14. The landmark input unit 14 receives input of information regarding landmarks, which includes positions and types, the positions and the types being regarded as index marks for the drive operation by the train driver. For example, each of the positions of the landmarks is indicated by a distance (kilometer distance or the like) from a base point, and each of the types of the landmarks, such as a signal and a construction, is inputted. As described above, the landmark refers to a railway facility such as a signal and an indicator, a construction on a periphery thereof, or the like, of which position is taken as an index mark for the drive operation by the train driver while the train is traveling. This is because the train driver memorizes the drive operation in association with the landmarks, frequently. Note that such examples of the landmark positions of FIG. 2 are shown by distances from the base point in the metric unit.

Note that, in Japanese Patent Application Laid-Open No. H05-105081 (1993), a position of the signal is used only in an event of generating the speed profile in order to obtain a changing position of the speed limit. That is to say, the signal is a device that, as a proper role, issues an instruction of the speed limit at a position where the speed limit is changed. On the other hand, the present invention uses the signal not only in the proper method of using the signal, which obtains the changing position of the speed limit, but also, in order to limit a switching position of the drive operation, as a position of the landmark by grasping the signal as a simple position of the construction separately from the proper role of the signal concerned.

The storage 15 holds the information, which is received by the generation condition input unit 11, the train performance input unit 12, the route information input unit 13 and the landmark input unit 14 so that the information thus received can be referred to from other processing units. The speed profile generator 16 uses the information, which is held by the storage 15, and generates such a speed profile that switches traveling modes by taking the positions of the landmarks as references.

Figures 4, 5:
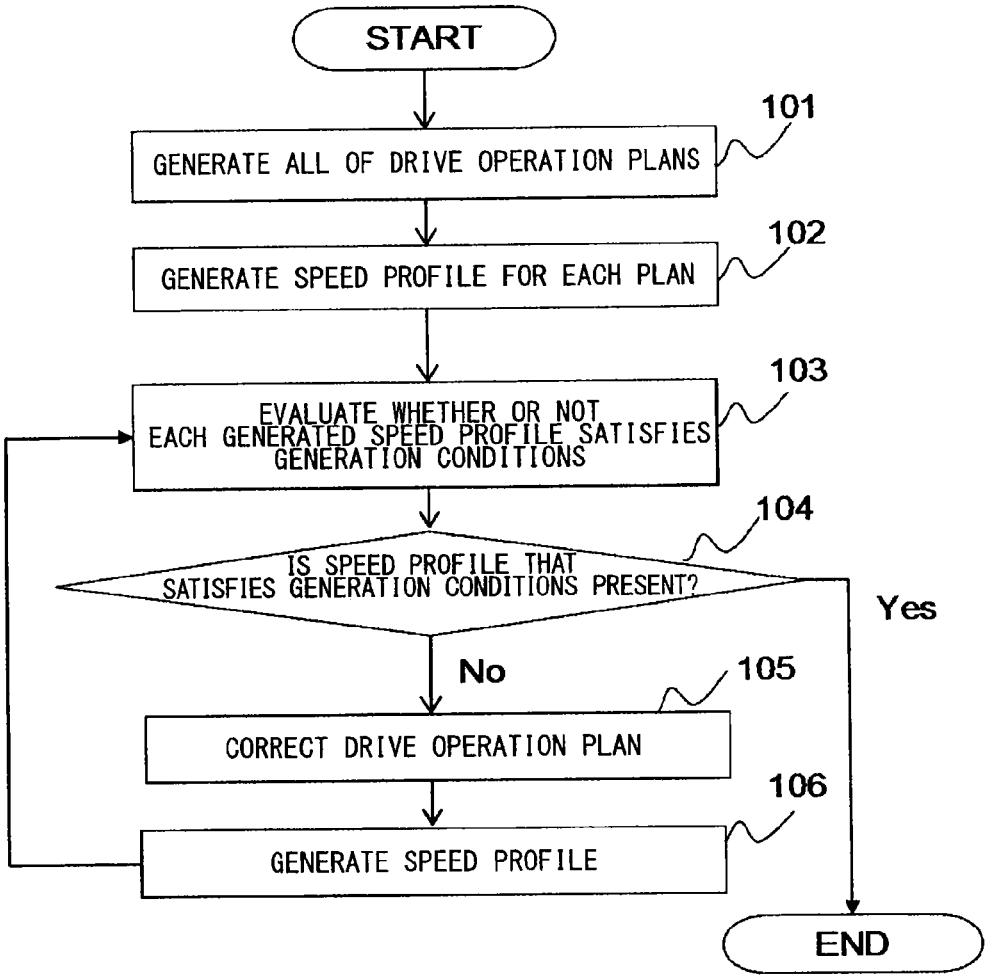
FIG. 4 is a flowchart of the speed profile generator in the first preferred embodiment of the present invention.
FIG. 5 is a table showing examples of drive operation plans in the speed profile generator in the first preferred embodiment of the present invention.

Next, a description is made of details of the speed profile generator 16 in this embodiment by using a configuration diagram of FIG. 3 and a flowchart of FIG. 4. The description is made of specific examples, which are: an example of generating a speed profile that switches the traveling modes in the vicinities of the positions of the landmarks while keeping a target traveling time schedule; and an example of generating a speed profile that switches the drive operation to a braking operation at a position that applies to (overlaps with) a brake pattern in which the ending position is defined as the pattern starting point. Therefore, in a drive operation plan, a starting point and an ending point of a certain traveling mode become positions where the landmarks are present in the peripheries, or positions which apply the brake pattern. Here, it is defined that the traveling mode is four traveling modes: an acceleration mode; a constant-speed mode; a coasting mode; and a deceleration mode.

Here, for the purpose of making it easy to understand the description, it is described that the traveling mode is switched in the vicinity of the position of the landmark; however, a spot where the landmark comes into sight or a spot where a relative position relationship between a train position and the landmark becomes a specific relationship may be defined as a reference position (spot) associated with the landmark. Position information made of the landmark includes such a case, and is information that takes the position of the landmark as a reference.

As shown in FIG. 3, the speed profile generator 16 is composed of a drive operation plan generator 17, a simulator 18, a speed profile storage 19, a speed profile evaluator 20, a speed profile selector 21, a drive operation plan corrector 22, and an output unit 23.

First, in the drive operation plan generator 17, drive operation plans are generated individually for all of combinations of the traveling modes (Step 101 of FIG. 4). In each of the drive operation plans, the traveling mode is switched at each point of time when the train reaches the landmark position held by the storage 15 and at a point of time when such a traveling position applies to the brake pattern of which the ending position is defined as the pattern starting point.

FIG. 5 is a table showing examples of the drive operation plans in the speed profile generator 17. For example, in Plan 2 of FIG. 5, a drive operation plan is formed, in which the train travels in the acceleration mode in a section where a position (distance) from the base point is 0 m to 250 m, travels in the constant-speed mode in a section where the position (distance) from the base point is 250 m to 500 m, travels in the coasting mode in a section where the position (distance) from the base point is 500 m to 850 m, and travels in the deceleration mode in a section where the position (distance) from the base point is 850 m to 1000 m. Here, the positions are managed by taking, as a unit, a meter from the base point; however, the positions can also be managed by the kilometer distance that takes, as a unit, a kilometer that is a distance from the base point.

Next, a speed profile in a case where the train travels in accordance with each of the traveling plans generated in Step 101 is generated in the simulator 18 for each of the traveling plans while considering the information about the gradient and the speed limit, which is stored by the storage 15 (Step 102 of FIG. 4). Here, in a case where the traveling position applies to the brake pattern in which the ending position is defined as the pattern starting point, the train travels in accordance with that pattern. The speed profile storage 19 stores each of the generated speed profiles together with the starting position, the ending position, the starting time and the ending time.

Figure 6:
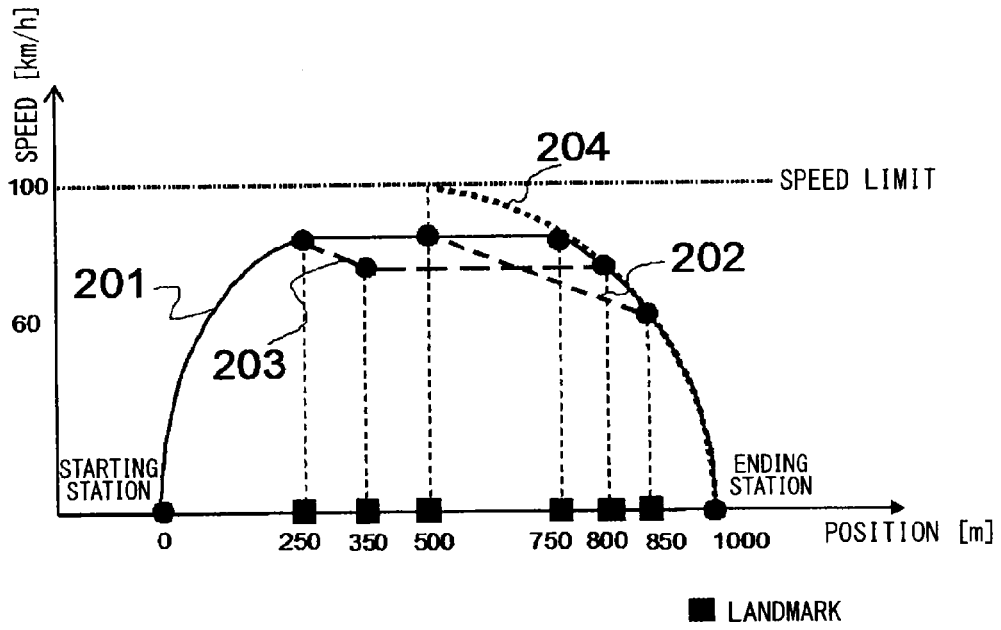
FIG. 6 is a chart showing an example of a speed profile generated by the speed profile generator in the first preferred embodiment of the present invention.

FIG. 6 is a graph showing an example of the speed profile generated in the speed profile generator 16. Reference numerals 201, 202 and 203 of FIG. 6 denote speed profiles of three drive operation plans in FIG. 5, respectively. Here, the starting position is at 0 m, the starting speed is 0 km/h, the ending position is at 1000 m, the ending speed is 0 km/h, and the landmarks are located at positions of 250 m, 350 m, 500 m, 750 m, 800 m and 850 m in terms of the distance from the base point. Moreover, the speed limit of the train is set at 100 km/h. Furthermore, reference numeral 204 of FIG. 6 denotes a brake pattern in which the ending position is defined as a pattern starting point.

Next, it is evaluated whether or not each of the generated speed profiles satisfies the generation conditions. That is to say, it is evaluated whether or not a speed profile, which has not been evaluated in the speed profile evaluator 20 yet among the speed profiles held in the speed profile storage 19, satisfies the target ending time (Step 103 of FIG. 4).

Next, a speed profile, which is evaluated to coincide with the target ending time, is selected by the speed profile selector 21. Then, by the output unit 23, the selected speed profile is outputted together with the speed profile and the drive operation plan, which are selected at present, and the processing is ended. In a case where the speed profile that coincides with the target ending time is not present, then a speed profile, in which an ending time is most approximate to the target ending time, and a drive operation plan thereof are selected (Step 104 of FIG. 4).

Next, in a case where the speed profile that satisfies the generation conditions is not present, then based on a difference between the ending time of the speed profile selected at present and the target ending time, the positions at which the traveling modes of the drive operation plan are switched are partially changed to correct the drive operation plan in the drive operation plan corrector 22 (Step 105 of FIG. 4).

Next, for the drive operation plan to which some changes are added in Step 105, the speed profile is generated in the simulator 18, and the generated speed profile is stored in the speed profile storage 19 together with the starting position, the ending position, the starting speed, the ending speed, the starting time and the ending time. Then, the processing returns to Step 103 (Step 106 of FIG. 4). In a case where the speed profile that satisfies the generation conditions is not present as a result of the evaluation by the speed profile evaluator, then a drive operation plan, in which the positions where the drive operation is changed are corrected, is generated, and is re-evaluated.

In accordance with the configuration described above, except for the case where the train travels along the brake pattern in which the ending position is defined as the pattern starting point, each of the positions at which the traveling mode is switched is located within a range of a certain distance from any of the positions included in the landmark input unit 14. Accordingly, it becomes possible to generate a speed profile that keeps the target traveling time while switching the traveling modes by taking the landmarks as references.

Note that, with regard to the drive operation plans considered in Step 101, a case of switching the traveling mode at the point of time when the train reaches a certain speed between the landmark positions is also considered in addition to the case of switching the traveling modes at the points of time when the train reaches the landmark positions, whereby it becomes possible to increase the drive operation plans, and it becomes easier to search a solution that satisfies the generation conditions.

Moreover, in a case where the train travels at a full speed or travels at a lowest speed, such drive operation plans that cannot occur are eliminated, whereby speed of calculations from Steps 101 to 103 can be enhanced.

Furthermore, as the information inputted to the generation condition input unit 11, the position information such as a station name and the kilometer distance may be used, or a departing speed or a passing speed may be specified. Moreover, the target traveling time schedule may be given in place of the starting time and the target ending time.

Moreover, the speed profile generation apparatus 1 may include the generation condition input unit 11, the train performance input unit 12, the route information input unit 13 and the landmark input unit 14; however, these input units do not have to be provided as long as the storage 15 can hold the information received by these input units. Furthermore, the speed profile generation apparatus 1 may include any of the generation condition input unit 11, the train performance input unit 12, the route information input unit 13 and the landmark input unit 14, or may include a plurality of input units selected therefrom. Moreover, the information may be inputted by using a single input unit in place of using the separate input units.

The above will not be described in descriptions of other embodiments in order to avoid unnecessary repetition; however, this also apples to the other embodiments.

As described above, the speed profile generation apparatus according to this embodiment is a speed profile generation apparatus including: the input units which receive the train performance, the route information, the information regarding the landmarks including the position information, the starting position and the ending position in the event of generating the speed profile, and the starting time and target ending time of the speed profile; and the speed profile generator that generates the speed profile based on the information inputted to the input units, the speed profile switching the traveling modes of the train by taking the positions of the landmarks as references. In this way, the speed profile generation apparatus can generate the speed profile that, while keeping the target traveling time schedule, switches the traveling modes by taking, as references, the positions serving as the index marks for carrying out the drive operation.

Moreover, the speed profile generator is a speed profile generator including: the drive operation plan generator that generates a plurality of the drive operation plans including a drive operation plan which takes the positions of the landmarks as references, and a drive operation plan that switches the traveling mode to the brake pattern at each point of time when the traveling position applies to the brake pattern in which the ending position is defined as the pattern starting point; the simulator that generates the speed profile based on the train performance, the route information and the drive operation plans; the speed profile evaluator that evaluates whether or not each of the speed profiles satisfies the generation conditions of the starting position and the ending position, and of the starting time and the target ending time; and the output unit that outputs the speed profile, which is evaluated to satisfy the generation conditions by the speed profile evaluator, as the speed profile. In this way, in response to the predetermined target traveling time schedule, the speed profile can be generated, from which it is easy for the train driver to grasp the position to perform the drive operation while keeping the speed limit.

Second Preferred Embodiment

In the first preferred embodiment, the speed profile is generated, which carries out the drive operation by taking the positions received by the landmark input unit 14 as references while satisfying the target traveling time schedule. However, it is assumed that the landmarks are different from one another in terms of a time period of being usable. For example, it is assumed that some landmarks cannot be visually recognized at night. Therefore, appropriate landmarks are selected in accordance with the starting time received by the generation condition input unit 11, whereby it becomes possible to generate a speed profile from which the train driver can grasp the positions of carrying out the drive operation in any time period.

Figure 7:
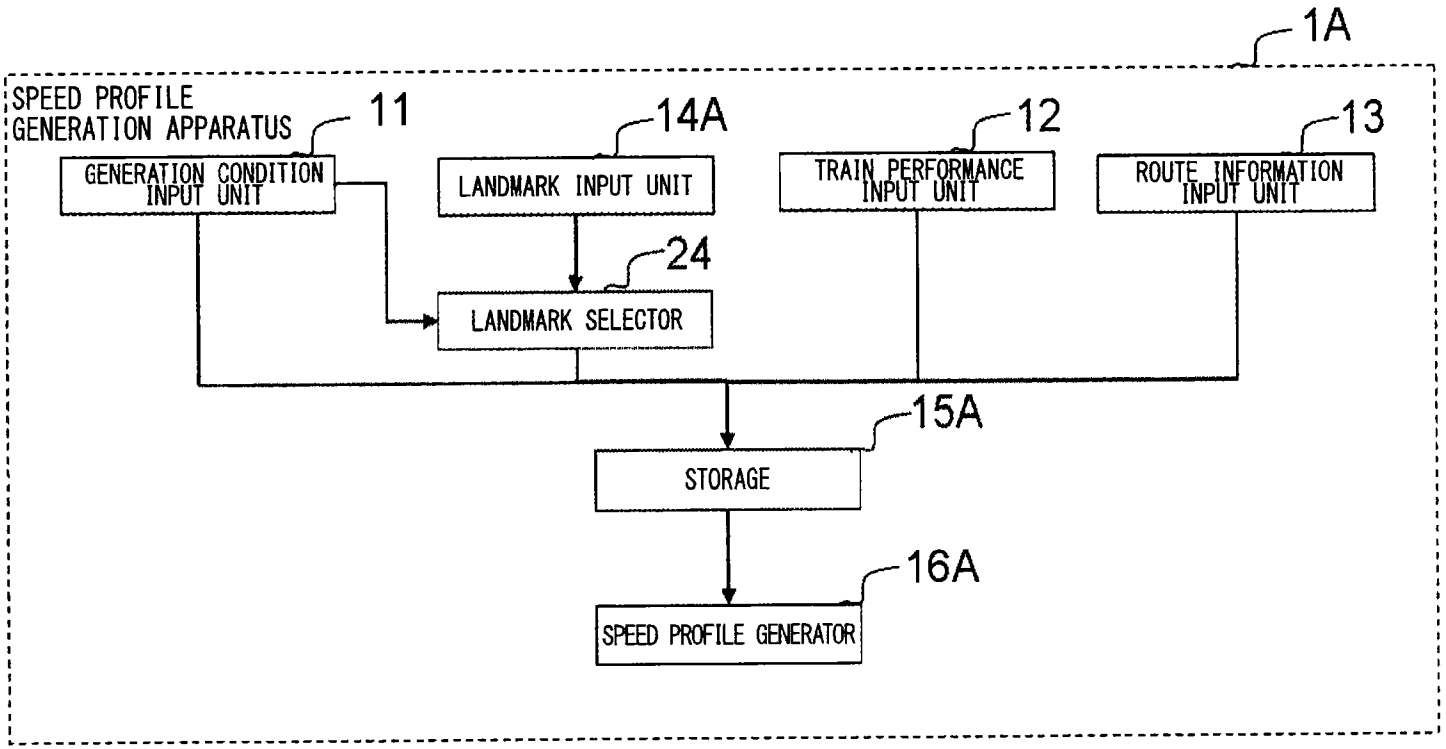
FIG. 7 is a configuration diagram of a speed profile generation apparatus in a second preferred embodiment of the present invention.

A description is made of a system configuration of a second preferred embodiment by using FIG. 7. A speed profile generation apparatus 1A is composed of a landmark selector 24 in addition to a generation condition input unit 11, a train performance input unit 12, a route information input unit 13, a landmark input unit 14A, a storage 15A and a speed profile generator 16A. The generation condition input unit 11, the train performance input unit 12 and the route information input unit 13 are similar to those of the first preferred embodiment. Note that the storage 15A functions similarly to the storage 15, and that the speed profile generator 16A functions similarly to the speed profile generator 16.

As shown in FIG. 8, the landmark input unit 14A includes the time periods when the landmarks are usable in addition to the positions of the landmarks and the types of the landmarks. The landmark selector 24 selects such landmarks that include a time from the starting time to the ending time, which are given by the generation condition input unit 11, in the time periods when the landmarks are usable, the time periods being inputted by the landmark input unit 14A. Then, the landmark selector 24 passes the selected landmarks to the storage 15A. Then, by using the information held by the speed profile generator 16A, such a speed profile that switches the traveling modes by taking the positions of the landmarks usable in the time periods as references is generated.

That is to say, whether or not information regarding the landmarks is used differs depending on information of the time periods. In this way, the speed profile generation apparatus can generate the speed profile that, while keeping the target traveling time schedule, switches the traveling modes by taking, as references, the positions serving as the index marks for carrying out the drive operation in the time periods when the train travels.

Note that, since sunlight conditions differ depending on seasons, the time periods when the landmarks are usable differ depending on the seasons in some case. In this case, season conditions and the like may be further added to the input conditions to the landmark input unit 14A.

In comparison with the first preferred embodiment, the second preferred embodiment is mainly different therefrom in that the landmark selector 24 is added. In other aspects, the second preferred embodiment is similar to the first embodiment. Note that, including other embodiments, those in which reference symbols such as A and B are added to reference numerals have basic functions and operations similar to those with only reference numerals; however, are partially different therefrom depending on the respective embodiments.

In accordance with the above-described configuration, the positions where the traveling modes are switched are located in the peripheries of the positions of any usable landmarks, and accordingly, it becomes possible to generate the speed profile from which the train driver can grasp the positions of carrying out the drive operation in any time period.

Third Preferred Embodiment

In each of the first and second preferred embodiments, the speed profile is generated, which carries out the drive operation by taking the positions received by the landmark input units 14 and 14A as references while satisfying the target traveling time schedule. In a case where a plurality of candidates for the speed profile as described above are present, then it is possible to generate a more appropriate speed profile by considering an amount of power consumption, a comfortable ride and the like.

Figure 9:
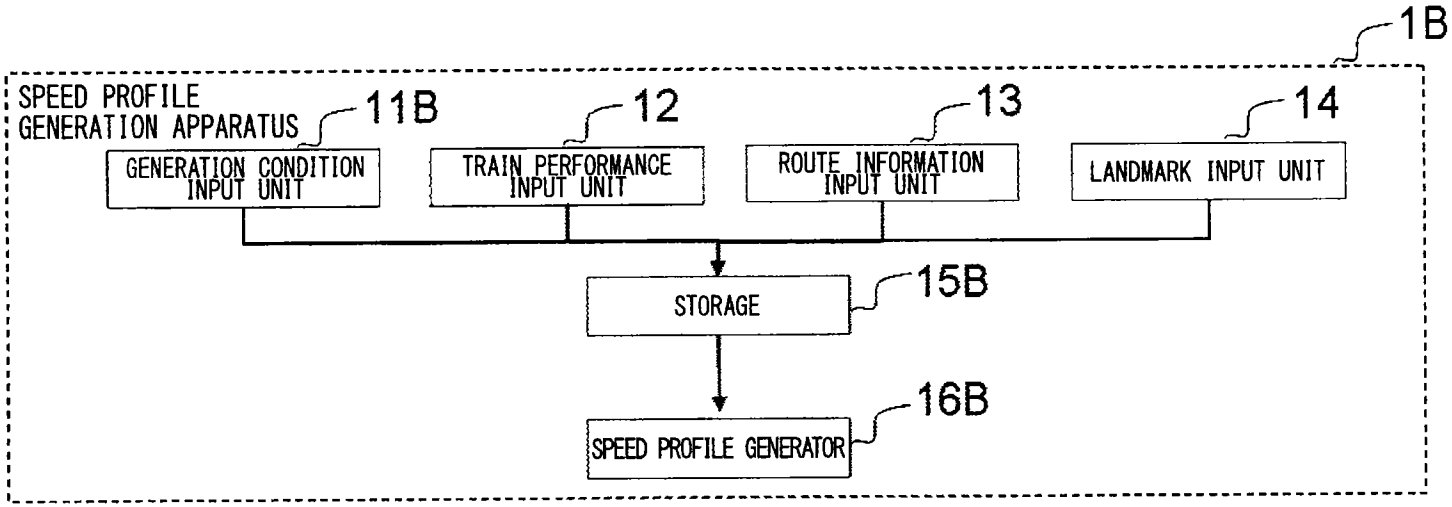
FIG. 9 is a configuration diagram of a speed profile generation apparatus in a third preferred embodiment of the present invention.

By using FIG. 9, a description is made of a configuration of a speed profile generation apparatus 1B according to a third preferred embodiment. The speed profile generation apparatus 1B is composed of a generation condition input unit 11B, a train performance input unit 12, a route information input unit 13, a landmark input unit 14, a storage 15B and a speed profile generator 16B. The generation condition input unit 11B also receives parameters, which are related to weight of a plurality of evaluation indices such as the amount of power consumption and the comfortable ride in a case where an objective function is composed of the plurality of evaluation indices, in addition to the starting position and the ending position, the starting speed and the ending speed and the starting time and the target ending time in the event of generating the speed profile. The storage 15B also holds, as the generation conditions, the parameters of the objective function in addition to the starting time, the target ending time, the starting position, the ending position, the starting speed and the ending speed.

Figure 10:
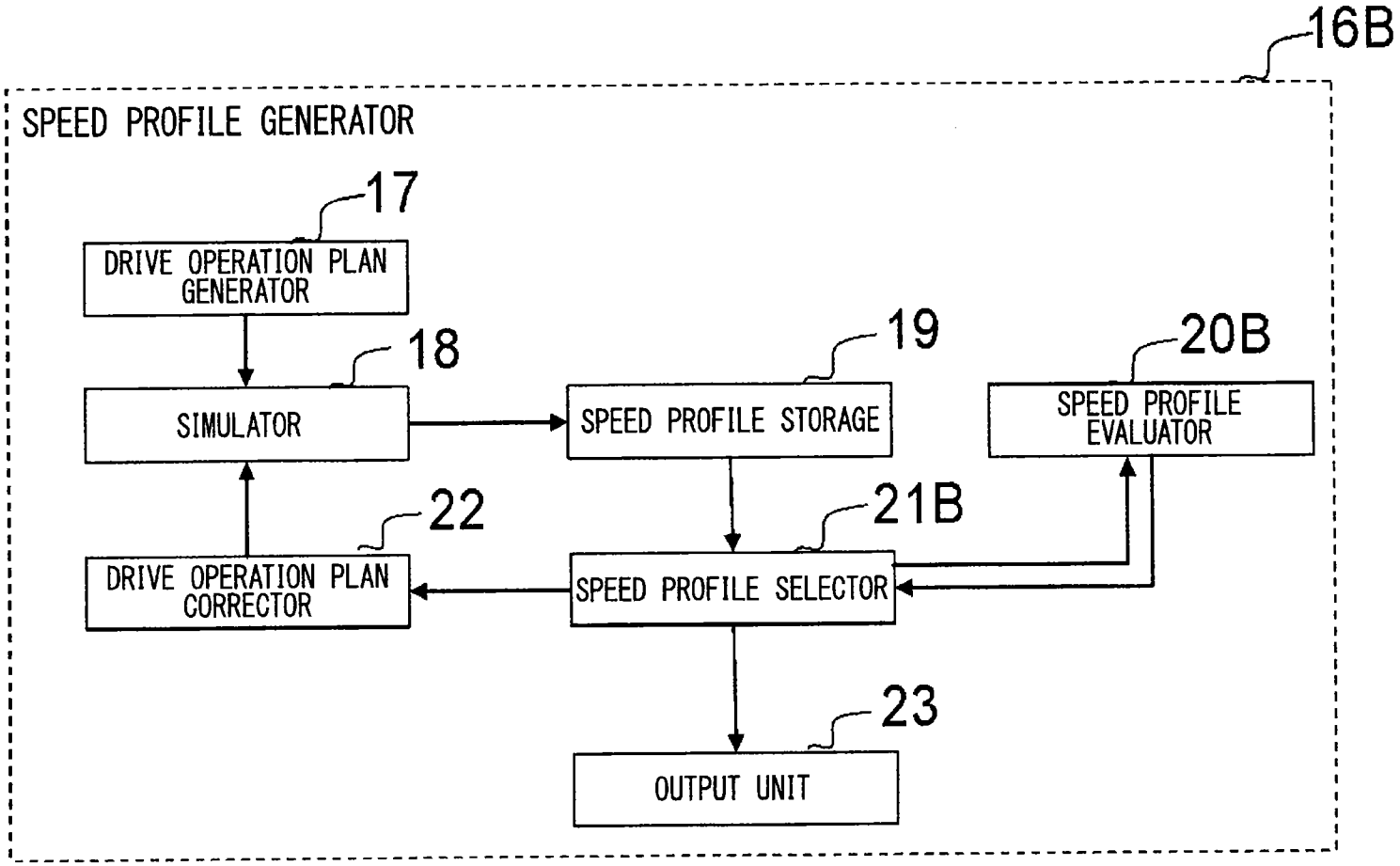
FIG. 10 is a configuration diagram of a speed profile generator in the third preferred embodiment of the present invention.

Next, details of the speed profile generator 16B in this embodiment are shown in a configuration diagram of FIG. 10. The speed profile generator 16B is composed of a drive operation plan generator 17, a simulator 18, a speed profile storage 19, a speed profile evaluator 20B, a speed profile selector 21B, a drive operation plan corrector 22, and an output unit 23. The speed profile evaluator 20B evaluates whether or not the speed profile satisfies the target ending time and the like, which are inputted by the generation condition input unit 11B, and in a case where the speed profile satisfies the inputted target ending time and the like, further evaluates the speed profile by the objective function. From among the speed profiles stored by the speed profile storage 19, the speed profile selector 21B selects a speed profile, which satisfies the target ending time and has a minimum value of the objective function as a result of the evaluation by the speed profile evaluator 20B, and passes the selected speed profile to the output unit 23. In a case where the speed profile that satisfies the target ending time is not present, the speed profile selector 21B selects a speed profile, in which an ending time is most approximate to the target ending time, and passes a drive operation plan of the selected speed profile to the drive operation plan corrector 22.

Figure 11:
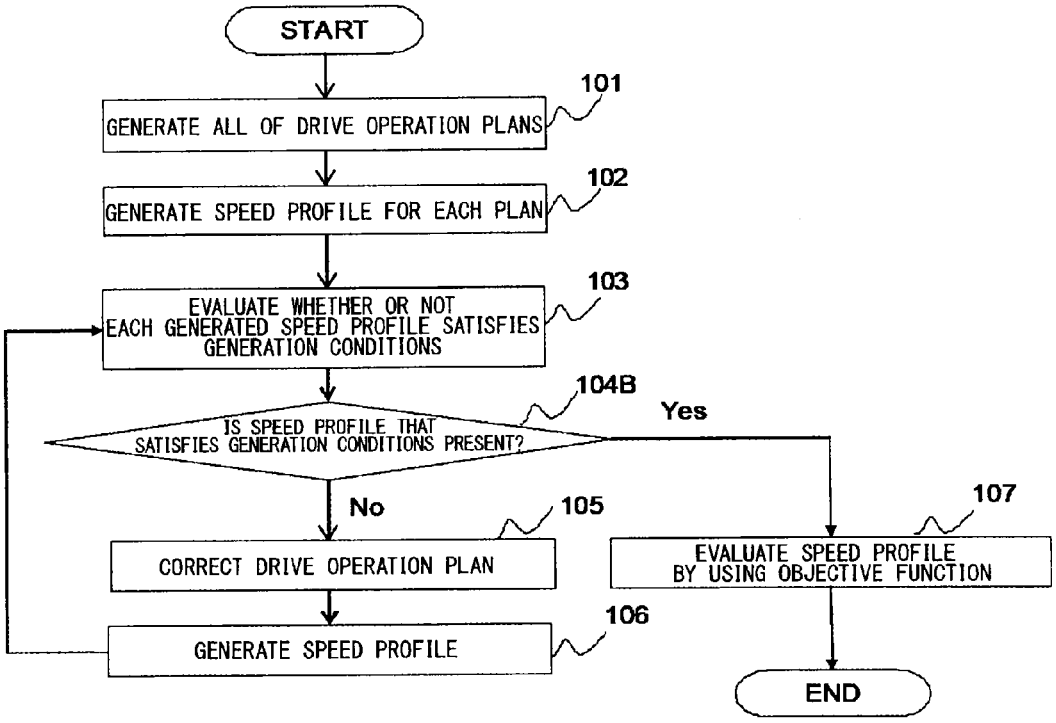
FIG. 11 is a flowchart of the speed profile generator in the third preferred embodiment of the present invention.

Next, a description is made of detailed operations of the speed profile generator 16B in this embodiment by using a flowchart of FIG. 11. In this embodiment, among such speed profiles that switch the traveling modes in the vicinities of the positions of the landmarks, or switches each of the traveling modes to the braking at the position applying to the brake pattern in which the ending position is defined as the pattern starting point, a speed profile is generated, which minimizes an objective function defined by the amount of power consumption while keeping the target traveling time schedule.

First, in the drive operation plan generator 17, drive operation plans, in each of which the traveling mode is switched at each point of time when the train reaches the landmark position held by the storage 15 and at a point of time when the traveling position applies to the brake pattern in which the ending point is defined as the pattern starting point, are generated individually for all of combinations of the traveling modes (Step 101 of FIG. 11).

Next, a speed profile in a case where the train travels in accordance with each of the drive operation plans generated in Step 101 is generated in the simulator 18 for each of the drive operation plans while considering the information about the gradient and the speed limit, which is held by the storage 15 (Step 102 of FIG. 11). Here, in a case where the traveling position applies to the brake pattern in which the ending position is defined as the pattern starting point, the train travels in accordance with that pattern. The speed profile storage 19 stores each of the generated speed profiles together with the starting position, the ending position, the starting speed, the ending speed, the starting time and the ending time.

Next, among the speed profiles generated in Step 102, those which are not evaluated whether or not to satisfy the generation conditions such as the target ending time are evaluated whether or not to satisfy the generation conditions in the speed profile evaluator 20B (Step 103 of FIG. 11).

Next, a speed profile, which is evaluated to coincide with the target ending time, is selected by the speed profile selector 21B. Then, in a case where the speed profile that coincides with the target ending time is not present, then a speed profile, in which an ending time is most approximate to the target ending time, and a drive operation plan thereof are selected (Step 104B of FIG. 11).

Next, in a case where the speed profile that satisfies the generation conditions is not present, then based on a difference between the ending time of the speed profile selected at present and the target ending time, the positions at which the traveling modes of the drive operation plan are switched are partially changed to correct the drive operation plan in the drive operation plan corrector 22 (Step 105 of FIG. 11).

Next, for the drive operation plan to which some changes are added in Step 105, the speed profile is generated in the simulator 18, and the generated speed profile is stored in the speed profile storage 19 together with the starting position, the ending position, the starting speed, the ending speed, the starting time and the ending time. Then, the processing returns to Step 103 (Step 106 of FIG. 11). In a case where it is evaluated by the speed profile evaluator 20B that the speed profile that satisfies the generation conditions is not present, then a drive operation plan in which the positions where the drive operation is changed are corrected is generated, and is re-evaluated.

Next, in a case where a plurality of the speed profiles evaluated to coincide with the target ending time are present in Step 104B of FIG. 11, the speed profiles are evaluated by using the objective function in the speed profile evaluator 20B. Here, each value of the amounts of power consumption is calculated. Then, a speed profile that minimizes the value of the objective function is selected by the speed profile selector 21B, and is outputted by the output unit 23 together with a drive operation plan thereof (Step 107 of FIG. 11).

In accordance with the configuration described above, the traveling modes are switched by taking the landmarks as references while keeping the target traveling time schedule, and it is possible to generate the speed profile in which the amount of power consumption is considered.

Moreover, also in this embodiment, it is possible to also generate such a speed profile that switches the traveling mode at the point of time when the train reaches a certain speed between the landmark positions.

Moreover, in the above-described example, the amount of power consumption is considered as the objective function; however, it is also possible to consider both of the comfortable ride and the amount of power consumption. The comfortable ride is evaluated by an evaluation index, for example, such as a jerk. At this time, when the weight of the amount of power consumption received in the generation condition input unit 11B is μ (real number from 0 to 1), the objective function is defined as follows.

$$V=\mu(\text{amount of power consumption from starting station to ending station})+(1-\mu)(\text{jerk caused from starting station to ending station}) \quad \text{[Expression 1]}$$

Note that, to the generation of the speed profile, a dynamic programming method and a method of applying heuristic such as a genetic algorithm are applicable besides the method at this time.

As described above, the plurality of speed profiles evaluated to satisfy the generation conditions by the speed profile evaluator are evaluated by the objective function that is based on the predetermined evaluation index, and the speed profile in which the value of the objective function becomes smallest is used. Moreover, it can be defined that the evaluation index includes at least either one of the amount of power consumption and the comfortable ride.

In this way, a speed profile with a small amount of power consumption and with good comfortable ride can be generated, the speed profile switching the traveling modes by taking, as references, the positions serving as the index marks for carrying out the drive operation while keeping the target traveling time schedule.

Fourth Preferred Embodiment

Figure 12:
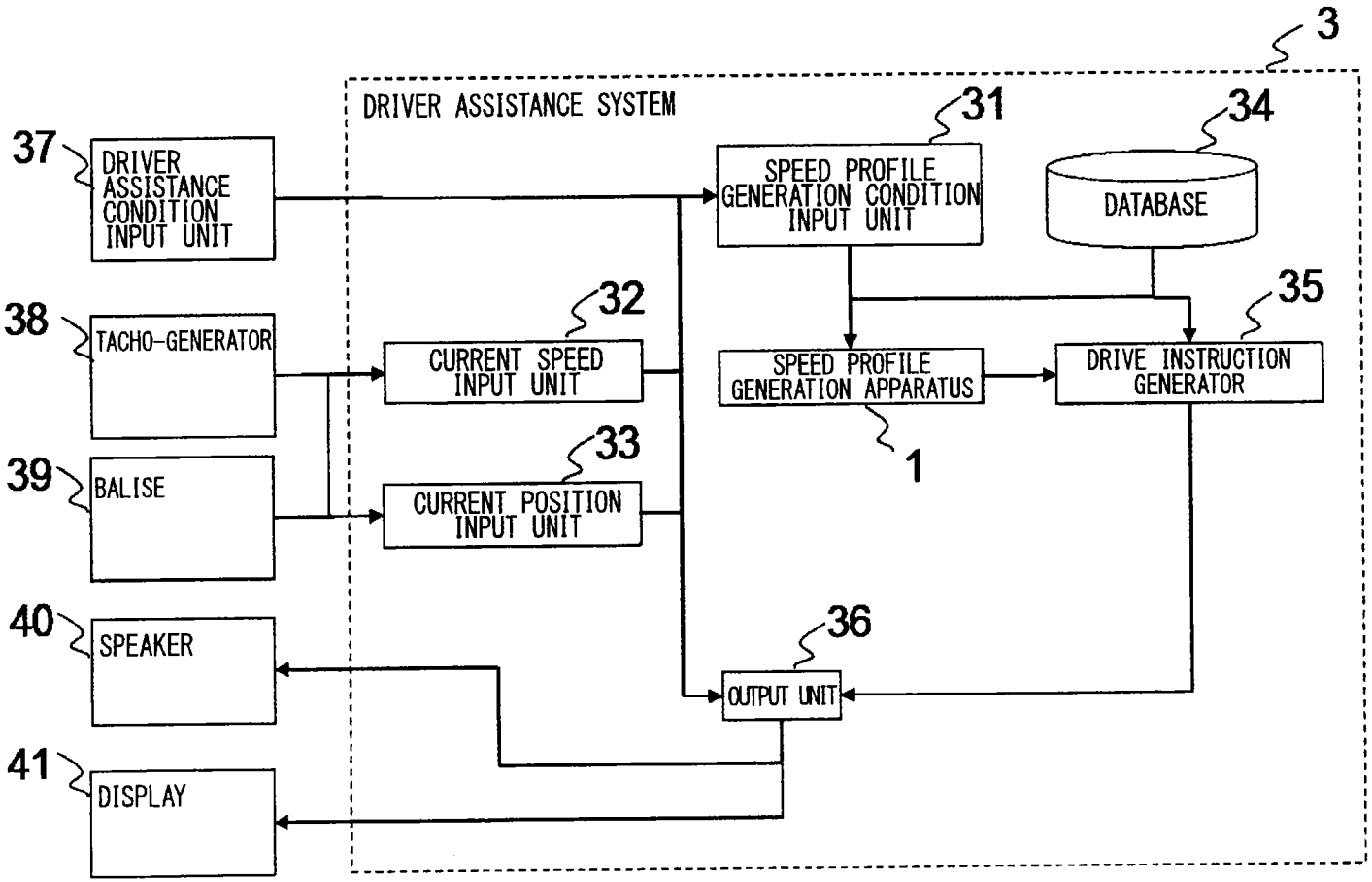
FIG. 12 is a configuration diagram of a driver assistance system in a fourth preferred embodiment of the present invention.

In this embodiment, a description is made of a driver assistance system including each of the speed profile generation apparatus of the first to third preferred embodiments. This embodiment is described by using FIG. 12. A driver assistance system 3 is composed of the speed profile generation apparatus 1, a speed profile generation condition input unit 31, a current speed input unit 32, a current position input unit 33, a database 34, a drive instruction generator 35, and an output unit 36. Moreover, the driver assistance system 3 is connected to a driver assistance condition input unit 37, a tacho-generator 38, a ground element sensor 39, a speaker 40 and a display 41.

The driver assistance condition input unit 37 receives input regarding the speed profile generation conditions such as the starting position, the ending position, the starting speed, and the ending speed, from a train crew. The current speed input unit 32 is connected to the tacho-generator 38, and obtains a current speed. The current position input unit 33 is connected to the tacho-generator 38 and the balise 39, and obtains a current position. Note that a way of obtaining the current train speed is not limited to this method, and may be a method using a wheel speed, a GPS (Global Positioning System) and the like. Moreover, the current position of the train can also be obtained by using the GPS, and by integration of a traveling distance from a position taken as a reference, and a way of obtaining the current position is not limited to the method described above.

The speed profile generation condition input unit 31 receives the generation conditions such as the starting time, the target ending time, the starting station and the ending station, which are received by the driver assistance condition input unit 37. With regard to the generation conditions, a speed received by the current speed input unit 32 and a position received by the current position input unit 33 may be defined as the starting speed and the starting position. These generation conditions are delivered to the speed profile generation apparatus 1.

The database 34 includes information regarding a route, such as current diagram information, the train performance, the speed limit and the gradient, the position of the curve and the curvature radius thereof, and information regarding the landmarks. The database 34 is connected to the speed profile generation apparatus 1 and the drive instruction generator 35. Here, the diagram information includes the starting position and starting time of the train traveling, and the ending position and ending time of the train traveling.

The speed profile generation apparatus 1 generates the speed profile in consideration of the generation conditions received by the speed profile generation condition input unit 31, and the information regarding the train performance, the route and the landmarks, which is held by the database 34.

The drive instruction generator 35 generates a drive operation instruction for allowing the train to travel along the speed profiles while referring to the information regarding the landmarks. In the embodiments mentioned above, the description is made on the assumption that the traveling modes are switched in the vicinities of the positions of the landmarks for the purpose of making it easy to understand the description. However, spots where the landmarks come into sight or spots where the relative position relationships between the train positions and the landmarks become the specific relationship may be defined as the reference positions (spots) associated with the landmarks. Therefore, each estimated time when the traveling mode is switched does not always coincide with an estimated time when the train actually passes through each landmark, and can be possibly prior to the estimated time when the train passes through the landmark. Accordingly, as shown in FIG. 13, the drive operation instruction includes information regarding positions where the traveling modes calculated from the speed profile generated by the speed profile generation apparatus 1 are switched, pieces of estimated time when the traveling modes are switched, and types of the traveling modes thus switched.

Note that, in a case of considering the case of switching the traveling mode at the point of time when the train reaches a certain speed between the landmark positions in addition to the case of switching the traveling modes at the points of time when the train reaches the landmark positions, speeds at which the traveling modes are switched, and the like may be further added to the drive operation instruction.

The output unit 36 is connected to notification means for the train driver, the notification means including the speaker 40, the display 41 and the like. Then, in the drive operation instruction generated by the drive operation generator 35, in a case where a time difference between the current time and the estimated time when the traveling mode is switched becomes a predetermined threshold value or less, the output unit 36 outputs the drive operation instruction to the notification means by using the position received by the current position input unit 33 and the speed received by the current speed input unit 32.

Moreover, in a case of treating the current position of the train as the starting position of the speed profile generation and treating the current speed of the train as the starting speed of the speed profile, then even in a case where a traffic state is not usual, an appropriate speed profile is obtained in real time, and the drive operation instruction is issued to the train driver.

Here, a description is briefly made of how the train driver actually switches the traveling modes of the train. The driver assistance technology by the speed profile obtained by using the train performance, the route information, the starting position and ending position of the speed profile generation, the starting time and target ending time of the speed profile, and the like completely regardless of the landmarks has been performed heretofore.

A train driver who has driven the train through the same route many times takes, as a reference, a mark that comes into sight thereof for determining a spot and timing at which the traveling mode is to be switched. A reason for this is as follows. In an event where an inexperienced train driver is trained from an experienced train driver, the inexperienced train driver is trained to determine the timing of switching the traveling mode by taking, as a reference, the mark that comes into sight thereof, and moreover, the inexperienced train driver visually memorizes the timing to switch the traveling mode. Such a mark to be memorized in this event is the landmark or the relative position relationship to the landmark.

As described above, the train driver switches the traveling mode by determining a certain index mark for the drive operation. An equivalent of this index mark is the position information of the landmark of this application, and the train traveling mode is switched by taking the position of the landmark as a reference. Such a way of taking a reference is adopted, whereby a drive operation instruction easily acceptable by the train driver is established.

In accordance with the above-described configuration, a railway system, in which it is easy for the train driver to grasp the position to perform the drive operation, can be realized by using the speed profile that switches the traveling modes by taking the landmarks as references.

Moreover, the display and the speaker are defined as the notification means for the train driver; however, the notification means is not limited to these. Moreover, the notification means may be incorporated in the driver assistance system.

Moreover, the tacho-generator and the balise are defined as means for acquiring the current speed and position; however, such acquisition means is not limited to this.

As described above, the driver assistance system according to this embodiment is a driver assistance system including: the database including the train performance, the route information, the information regarding the landmarks including the position information, and timetable information; the speed profile generation apparatus in which the information of the database is inputted to the input unit; and the drive operation instruction generator that generates the drive operation instruction based on the speed profile generated by the speed profile generation apparatus. Moreover, the current position of the train is defined as the starting position of the speed profile generation, and the current speed of the train is defined as the starting speed of the speed profile, and the current position and the current speed are inputted to the input unit.

In this way, by using the speed profile switched by taking as references the positions serving as the index marks for carrying out the drive operation, a notice of the drive operation instruction is issued to the train driver immediately before performing the drive operation, whereby the railway system is formed, in which it is easy for the train driver to grasp the position to perform the drive operation.

Fifth Preferred Embodiment

Figure 14:
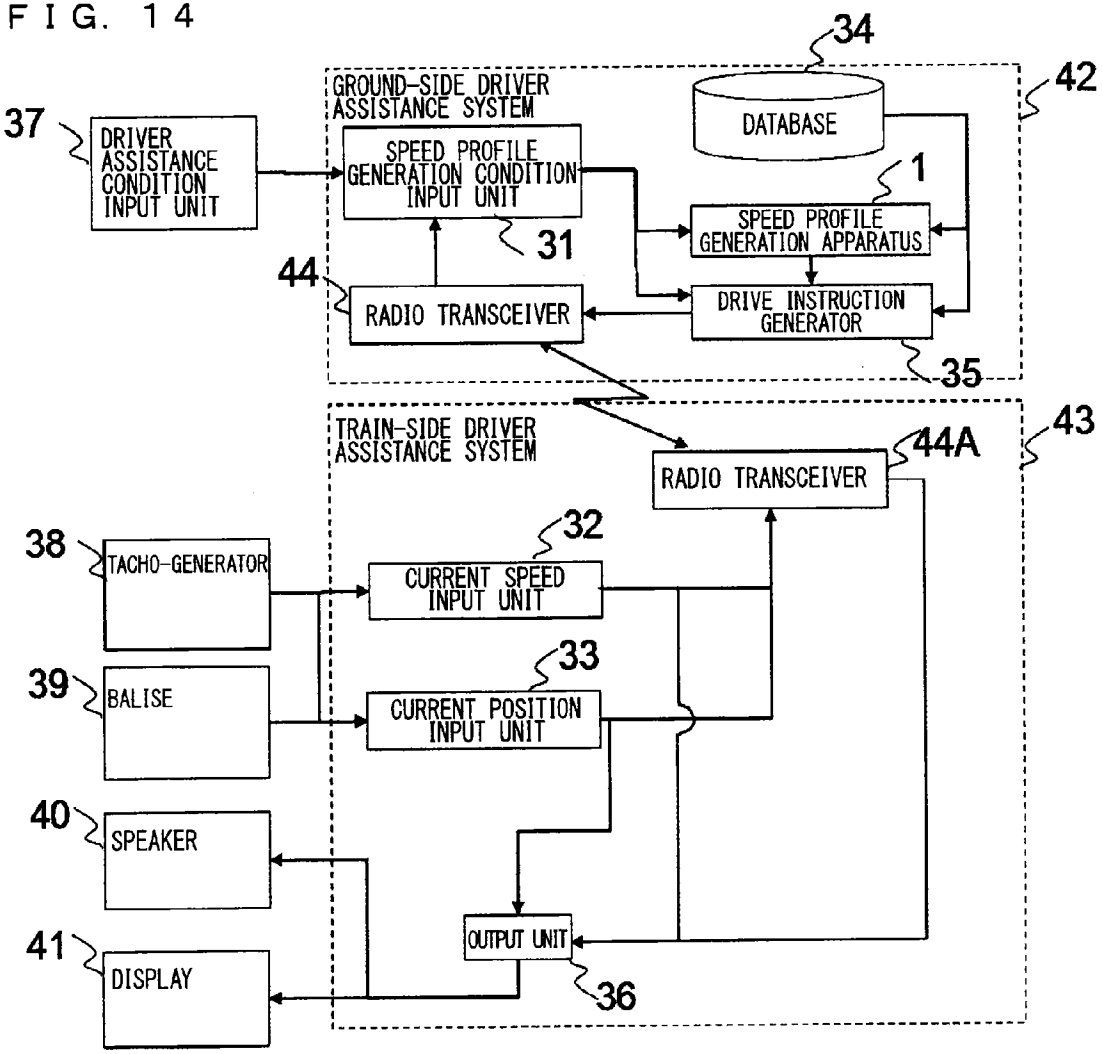
FIG. 14 is a configuration diagram of a driver assistance system in a fifth preferred embodiment of the present invention.

In the fourth preferred embodiment, the configuration of the driver assistance system 3 may be arranged so that constituents thereof can be separated into those for the ground system and the on-board system. A description is made of this embodiment by using FIG. 14.

The driver assistance system is composed of a ground-side driver assistance system 42 and a train-side driver assistance system 43. The ground-side driver assistance system 42 is composed of a speed profile generation apparatus 1, a speed profile generation condition input unit 31, a database 34, a drive instruction generator 35, and a radio transceiver 44. Moreover, the ground-side driver assistance system 42 is connected to a driver assistance condition input unit 37. The train-side driver assistance system 43 is composed of a current speed input unit 32, a current position input unit 33, an output unit 36, and a radio transceiver 44A. Moreover, the train-side driver assistance system 43 is connected to a tacho-generator 38, a balise 39, a speaker 40, and a display 41. Here, the speed profile generation apparatus 1, the current speed input unit 32, the current position input unit 33, the database 34, the drive instruction generator 35, the tacho-generator 38, the ground element sensor 39, the speaker 40 and the display 41 are similar to those of the fourth preferred embodiment.

The speed profile generation condition input unit 31 receives the generation conditions for the starting time, the target ending time, the starting station, the ending station and the like, which are received by the driver assistance condition input unit 37. Moreover, it is also possible to use the speed and the position, which are acquired by the current speed input unit 32 and the current position input unit 33, as the generation conditions through the wireless transceivers 44A and 44. Moreover, the drive operation instruction generated by the drive instruction generator 35 is delivered to the output unit 36 through the wireless transceivers 44A and 44.

In accordance with the above-described configuration, a railway system can be realized, in which it is easy for the train driver to grasp the position to perform the drive operation while reducing a processing load on the train side.

Sixth Preferred Embodiment

In the fourth preferred embodiment, all of the landmarks are used as the references of the positions at which the traveling modes are switched. Therefore, there is a possibility that a speed profile in which the traveling mode is switched at a first landmark from the starting position may be generated. However, in a case where the starting position and the first landmark are close to each other, it is necessary for the train driver to carry out the drive operation immediately after the speed profile is generated, and a possibility that the train cannot travel in accordance with the speed profile is increased. Accordingly, in this embodiment, landmarks within a predetermined distance from the current position of the train are not used as the references of the positions at which the traveling modes are switched, whereby a speed profile that facilitates the train to be driven is obtained.

Figure 15:
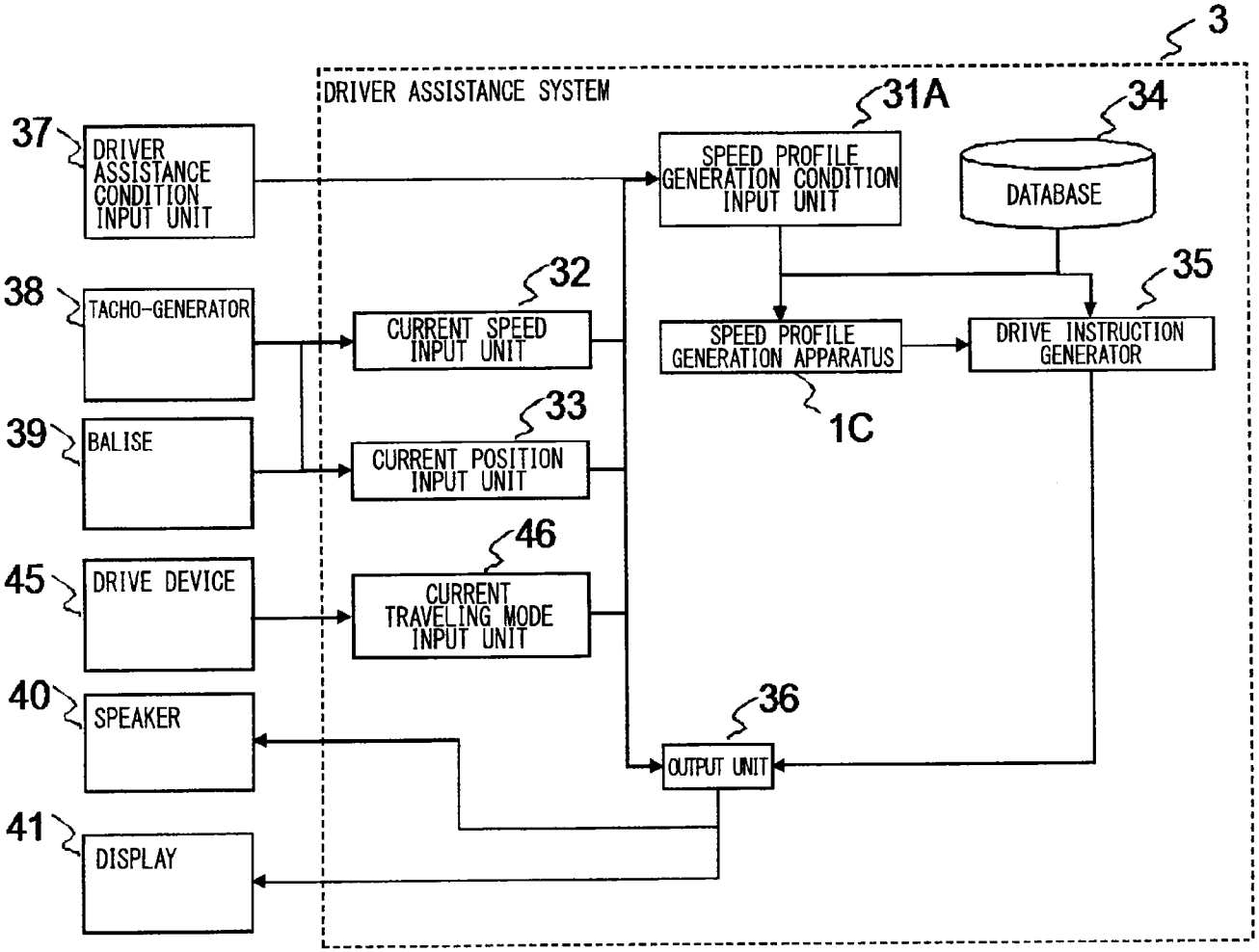
FIG. 15 is a configuration diagram of a driver assistance system in a sixth preferred embodiment of the present invention.
Figure 16:
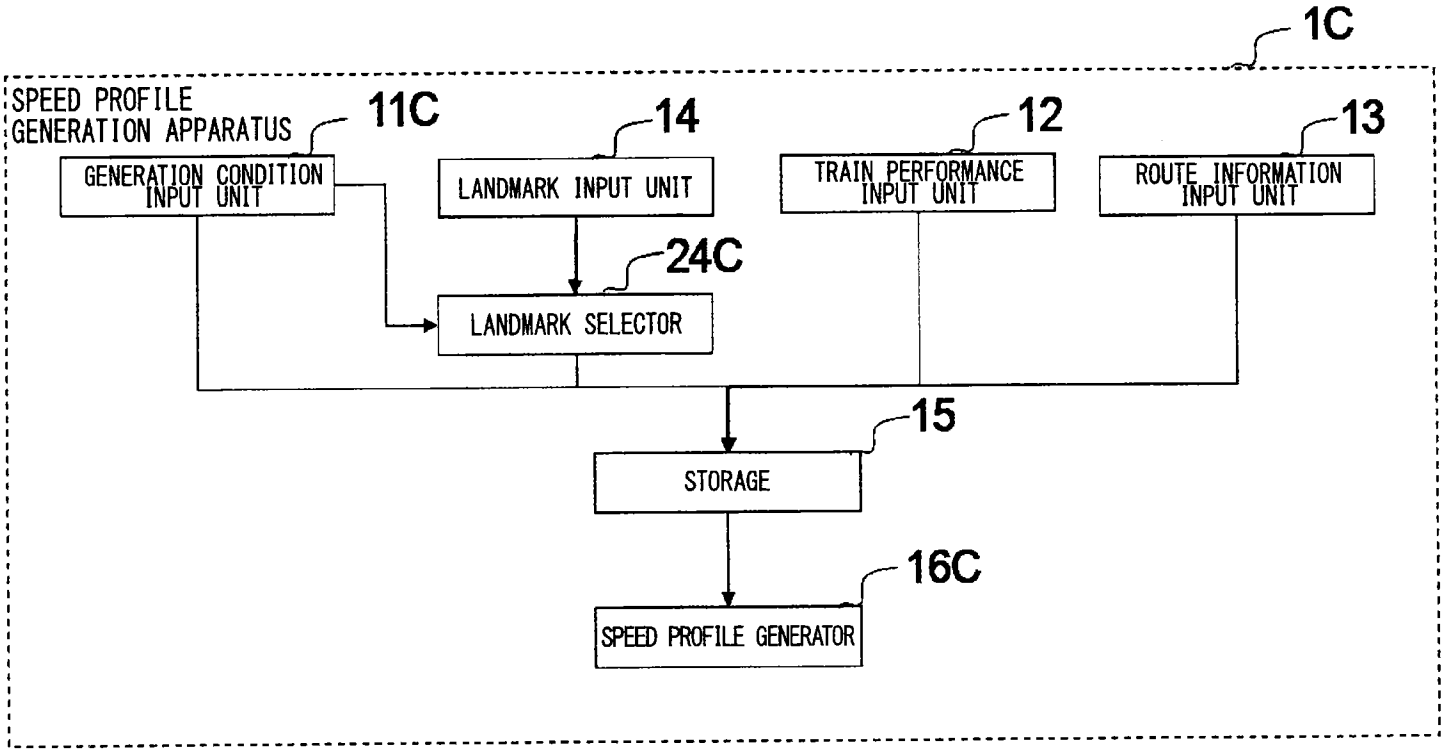
FIG. 16 is a configuration diagram of a speed profile generation apparatus in the sixth preferred embodiment of the present invention.

FIG. 15 shows a configuration of this embodiment. A speed profile generation condition input unit 31A also receives a skip traveling mode, which is a traveling mode received by a current traveling mode input unit 46 from a drive device 45 such as a motor and a brake, in addition to the target ending time and the ending station, which are received by the driver assistance condition input unit 37, the speed received by the current speed input unit 32, and the position received by the current position input unit 33. These generation conditions are delivered to a generation condition input unit 11C of a speed profile generation apparatus 1C, which is shown in FIG. 16.

Figure 17:
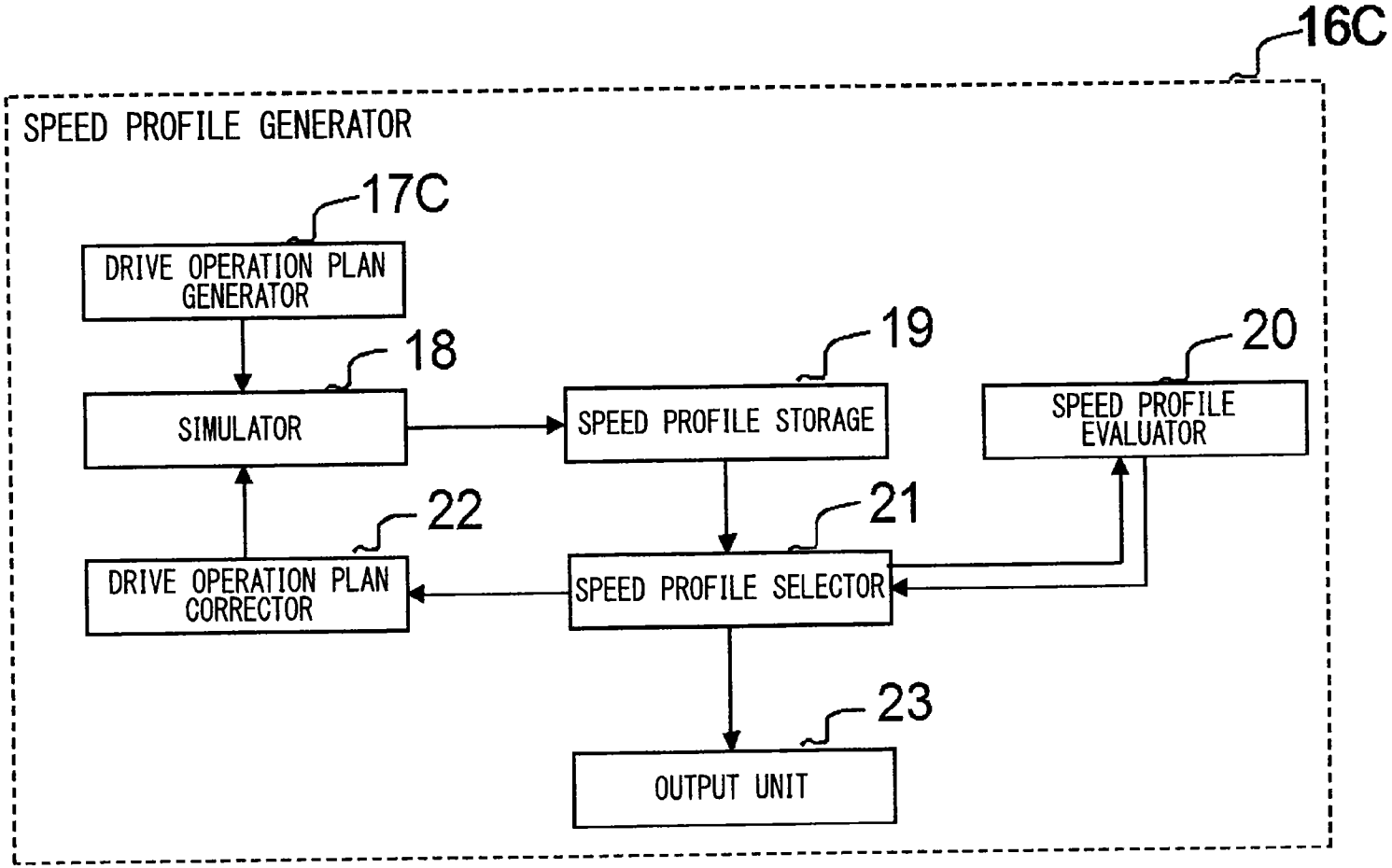
FIG. 17 is a configuration diagram of a speed profile generator in the sixth preferred embodiment of the present invention.

Moreover, the speed profile generation apparatus 1C includes a landmark selector 24C. The landmark selector 24C eliminates the landmarks within the predetermined distance from the current position (starting position of the speed profile), which is inputted in the generation condition input unit 11C, from among the landmarks received by the landmark input unit 14. Moreover, as shown in FIG. 17, a drive operation plan generator 17C of a speed profile generator 16C generates such a drive operation plan that the train travels to the landmark closest to the current position among the landmarks, which are selected by the landmark selector 24, in accordance with a traveling mode received by the generation condition input unit 11C, that is, the skip traveling mode.

Figure 18:
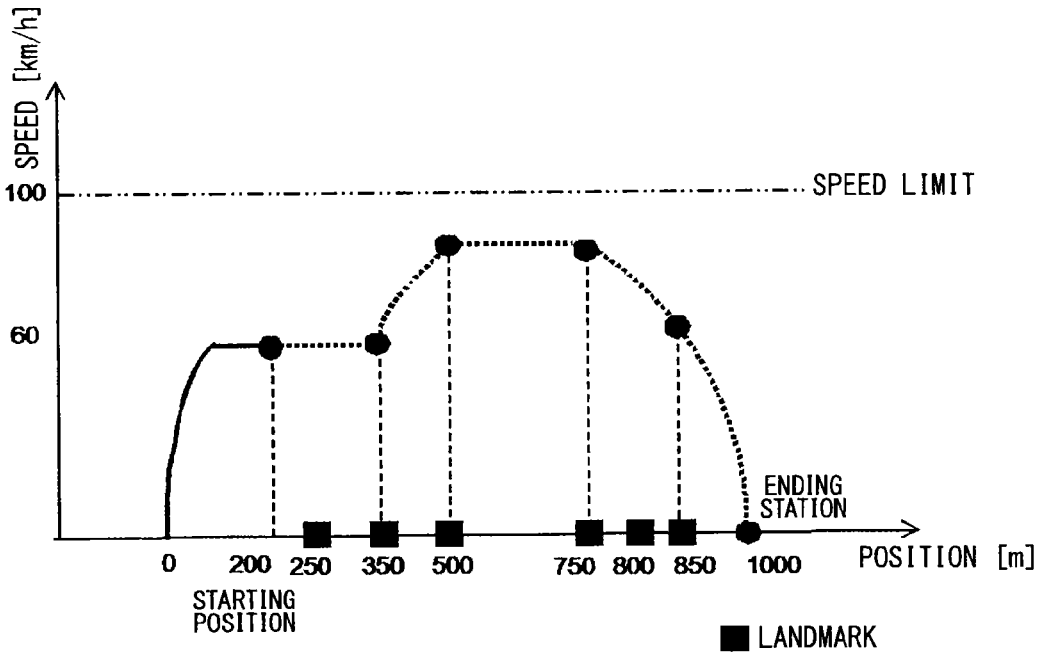
FIG. 18 is a chart showing an example of a speed profile generated by a speed profile generator in the sixth preferred embodiment of the present invention.

FIG. 18 is a chart showing an example of the speed profile generated by the drive operation plan generator 17C. The starting position is at a 200 m, the starting speed is 60 km/h, and the current traveling mode is the constant-speed mode. The landmark closest to the starting position is located at a distance of 250 m; however, this landmark is determined to be located close to the starting position. Therefore, in the generated speed profile, a constant-speed traveling mode (skip traveling mode) is set to the next landmark (350 m).

As described above, the skip traveling mode is further inputted to the input unit, and the speed profile generator generates the speed profile, in which the train travels in accordance with the skip traveling mode, from the starting position of the speed profile to the landmark apart therefrom by a predetermined distance or more.

In accordance with the above-described configuration, also in a case where a deviation occurs between the speed profile generated in advance and an actual speed profile while the train is traveling between the stations, and even if it becomes necessary to update the speed profile, a time to issue a notice of the drive operation to the train driver can be ensured after the traveling plan is updated. Accordingly, a speed profile that facilitates the train to be driven can be obtained.

While the invention has been shown and described in detail, the foregoing description is in all aspects illustrative and not restrictive. It is therefore understood that numerous modifications and variations can be devised without departing from the scope of the invention.

What is claimed is:

1. A speed profile generation apparatus comprising:

an input interface that receives train performance, route information, information regarding a landmark including position information, a starting position and an ending position for generating a speed profile, and a starting time and a target ending time of said speed profile; and a speed profile generator that generates said speed profile based on the information received by said input interface, the speed profile switching between traveling modes of a train by taking in consideration 1) a position of said landmark as a reference for implementing said speed profile switching and 2) a target traveling time schedule between the starting position and the ending position.

2. The speed profile generation apparatus according to claim 1, wherein said speed profile generator includes:

a drive operation plan generator that generates a plurality of drive operation plans including a drive operation plan taking the position of said landmark as a reference, and a drive operation plan switching a traveling mode to a brake pattern in which an ending position is defined as a starting point of the pattern at a point of time when a traveling position of the train applies to said brake pattern;

a simulator that generates a speed profile plan based on the train performance, the route information and said drive operation plans;

a speed profile evaluator that evaluates whether or not said speed profile plan satisfies generation conditions of the starting position and the ending position, and the starting time and the target ending time; and an output interface that outputs, as a speed profile, said speed profile plan being evaluated to satisfy the generation conditions by said speed profile evaluator.

3. The speed profile generation apparatus according to claim 2, wherein, in a case where said speed profile plan that satisfies the generation conditions is not present in said speed profile evaluator, said speed profile generators generates a drive operation plan in which a position for changing a drive operation is corrected and said speed profile evaluator re-evaluates the connected operation plan.

4. The speed profile generation apparatus according to claim 2, wherein said speed profile plan includes a plurality of speed profile plans which are evaluated to satisfy the generation conditions by said speed profile evaluator, and said speed profile generator evaluates said plurality of speed profile plans, by an objective function that is based on a predetermined evaluation index, and defines a speed profile plan having a smallest value of the objective function as the speed profile.

5. The speed profile generation apparatus according to claim 4, wherein said predetermined evaluation index includes at least one of an amount of power consumption and a ride.

6. The speed profile generation apparatus according to claim 1, wherein whether or not the information regarding said landmark is used differs depending on time period information.

7. The speed profile generation apparatus according to claim 1, wherein a skip traveling mode is further inputted to said input interface, and said speed profile generator generates a speed profile allowing the train to travel in accordance with said skip traveling mode, from the starting position of the speed profile to a landmark apart from the starting position by a predetermined distance or more.

8. A driver assistance system comprising:

a database including train performance, route information, information regarding a landmark including position information and timetable information;

the speed profile generation apparatus according to claim 1, said input interface of said speed profile generation apparatus receiving the information of said database; and a drive operation instruction generator that generates a drive operation instruction based on a speed profile generated by said speed profile generator.

9. The driver assistance system according to claim 8, wherein a current position of a train is defined as the starting position of speed profile generation, a current speed of said train is defined as a starting speed of the speed profile, and the current position and the current speed are inputted to said input interface.

* * * * *